United States Patent [19]

Fey et al.

[11] 4,424,548

[45] Jan. 3, 1984

[54] CENTRAL LOCKING SYSTEM FOR LOCKABLE ENTRIES OF BUILDINGS OR VEHICLES, PARTICULARLY MOTOR VEHICLES

[75] Inventors: Rainer Fey, Schweinfurt; Gerhard Dumbser, Niederwerrn; Arthur Laun, Gochsheim, all of Fed. Rep. of Germany

[73] Assignee: Fichtel & Sachs AG, Schweinfurt, Fed. Rep. of Germany

[21] Appl. No.: 285,990

[22] Filed: Jul. 23, 1981

[30] Foreign Application Priority Data

Aug. 13, 1980 [DE] Fed. Rep. of Germany ..... 3030569

[51] Int. Cl.[3] ..... H01H 47/22

[52] U.S. Cl. ..... 361/152; 361/156; 361/167; 361/191

[58] Field of Search ..... 361/156, 167, 191, 208, 361/210, 192, 152; 70/264, 280; 180/289; 307/10 AT, 10 R

[56] References Cited

U.S. PATENT DOCUMENTS 3,612,207 10/1971 Cabanes ..... 70/264 X
3,695,381 10/1972 Okada et al. ..... 70/264 X

FOREIGN PATENT DOCUMENTS 2757246 9/1977 Fed. Rep. of Germany .
2914914 7/1979 Fed. Rep. of Germany .

OTHER PUBLICATIONS

"Engineer's Relay Handbook" Hayden Book Company, Inc. ©1966, 1969, p. 126.

*Primary Examiner*—Harry E. Moose, Jr.
*Attorney, Agent, or Firm*—Toren, McGeady and Stanger

[57] ABSTRACT

A central locking system particularly suitable for use in a motor vehicle to lock or open, at one time, all the vehicle doors from any one of a number of locations, includes at least one lock bolt mechanism which provides movement in a selected one of a locking and a release direction to locking elements at the vehicle doors. At least one control switch which may be located at the door on the driver's side of the vehicle is selectively actuable to one of first and second switch positions, and is arranged together with a pulse drive circuit including a capacitor to provide a first drive pulse to the lock bolt mechanism when the control switch is in the first switch position. The first drive pulse causes the lock bolt mechanism to move the locking elements at the vehicle doors in one of the locking and release directions, and is produced by the capacitor in response to a charging current supplied to the capacitor by a charging current circuit. When the control switch is in the second position, a discharging current circuit is coupled to the capacitor and directs a discharging current from the capacitor. This allows the capacitor to provide a second drive pulse to the lock bolt mechanism, and causes the mechanism to move the locking elements at the vehicle doors in the other one of the locking and release directions.

7 Claims, 7 Drawing Figures

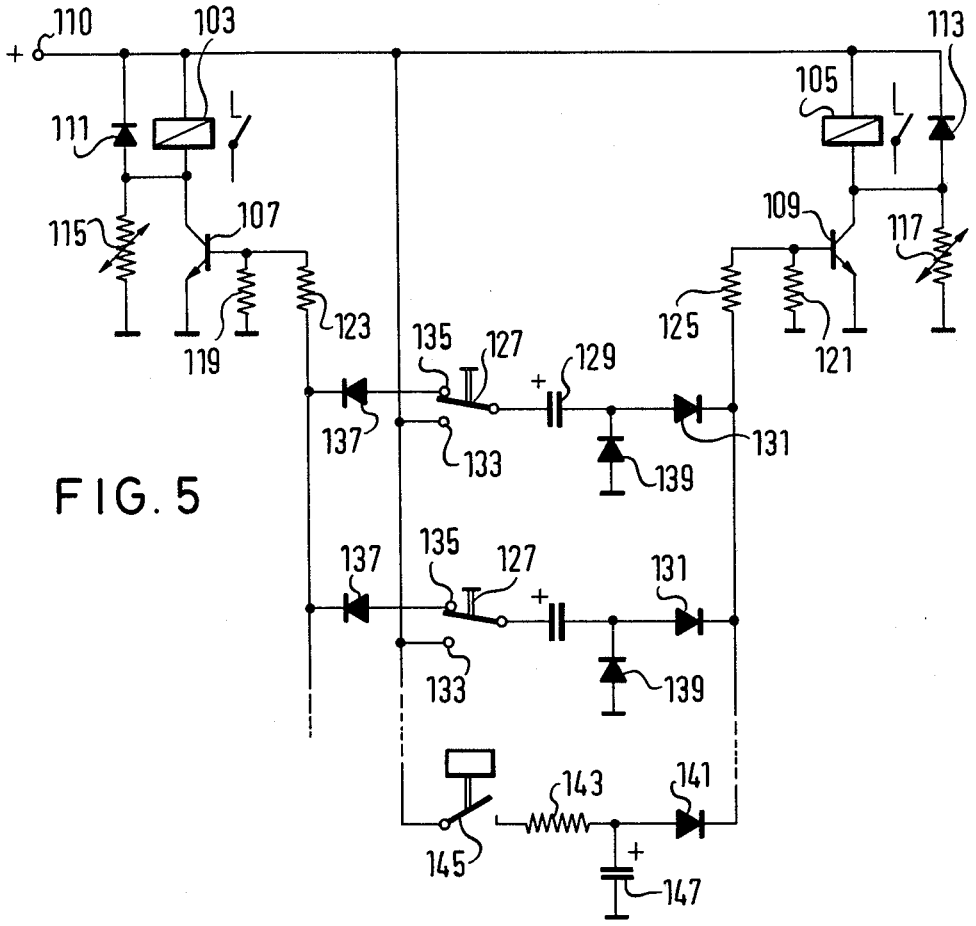
FIG. 5
FIG. 6
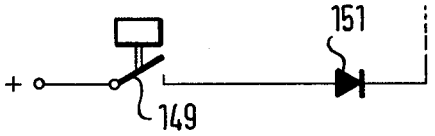
FIG. 7
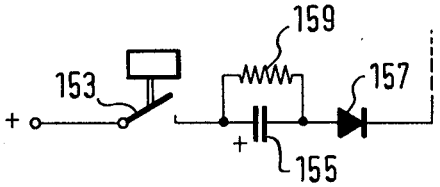

CENTRAL LOCKING SYSTEM FOR LOCKABLE ENTRIES OF BUILDINGS OR VEHICLES, PARTICULARLY MOTOR VEHICLES

BACKGROUND OF THE INVENTION

The present invention relates to a central locking system for closure members of buildings or vehicles, particularly motor vehicles. The system includes a number of electric lock bolt mechanisms, and a pulse drive circuit which is controlled by at least one control switch. When the control switch is moved to a first position, the pulse drive circuit emits a single drive pulse to each of the lock bolt mechanisms for providing lock movement in a first direction. When the control switch is moved to a second position, the circuit emits a single drive pulse to the lock bolt mechanisms for providing lock movement in a second direction.

German OS No. 27 57 246 discloses a locking system for motor vehicles in which a control switch, which is located at a door on the driver's side of the vehicle and which can be activated with the door key, controls lock bolt mechanisms of the other vehicle doors and, as an option, the vehicle luggage compartment hood. Accordingly, the doors and the hood all can be locked or unlocked centrally. To limit the time during which current flows, only one pulse-like driving signal is transmitted from a pulse drive circuit to the lock bolt mechanisms for both directions of lock movement. In the known system, the pulse drive circuit has a relay which switches an induction current to each of the lock bolt mechanisms for each of the two directions of lock movement. The two relays are selectively connected to a power source by the control switch with the aid of a power switching transistor. The power switching transistor is controlled by a timing element which is triggered during switching of the control switch to turn on the power switching transistor for the duration of the time constant of the element. The time constant of the timing element is determined by a resistor-capacitor network.

Only a single control switch is provided in the known system, so that the system can be locked or unlocked from only one location on the vehicle such as a vehicle door. Since the timing element is triggered in response to voltage change from actuation of the control switch, a trigger protection circuit is necessary to prevent the system from being unlocked by tampering with the operating voltage, e.g., by disconnecting the vehicle battery. Consequently, the cost expended for circuit components in the known system is relatively high.

An object of the present invention is to provide a central electric locking system of lockable entries of buildings or vehicles, particularly motor vehicles, which system does not respond to tampering of a supply voltage so as to provide a high degree of safety, but nevertheless operates with relatively few components which are available commercially.

According to the invention, the above and other objects are attained by providing a control switch and a capacitor arranged so that in a first position of the control switch, the capacitor is connected to a charging current circuit wherein the capacitor charging current defines a drive pulse for a first lock drive direction, and in a second position of the control switch, the capacitor is connected to a discharging current circuit wherein the capacitor discharging current defines a drive pulse for a second lock drive direction. The capacitor determines the duration of the drive pulses for both drive directions. When the control switch is in the first position, the duration of the drive pulse is determined by the time constant of the charging current circuit, and when the switch is in the second position the drive pulse duration is determined by the time constant of the discharging current circuit. When in the second position, the control switch disconnects the capacitor from the charging current circuit. Therefore, tampering of the operating voltage source cannot serve to recharge the capacitor, which is discharging when the switch is in the second position. After the control switch is placed in the first position, the capacitor attains and stores a certain charge, even if the operating voltage is tampered with later.

The lock bolt mechanisms can drive the locking elements of the locks at, e.g., the doors or hoods of a motor vehicle, as is customary in central locking systems. The lock bolt mechanisms can also actuate separate stop members to prevent manual unlocking of the vehicle doors. Such stop members may include bolts arranged to prevent manual unlocking of the door lock button on a locked motor vehicle door.

In a preferred embodiment, the control switch is of a single-pole type forming a selected one of a first contact path and a second contact path. The first contact path connects a power source in series with a capacitor, and either a lock bolt mechanism for providing lock movement in a first direction or a switching stage which switches driving current for the lock bolt mechanism. The second contact path connects the capacitor in parallel with either the lock bolt mechanism to provide lock movement in a second direction, or with a switching stage. Therefore, the current which flows through the capacitor during charging or discharging directly drives the lock bolt mechanisms or their associated switching stages. The use of switching stages is preferred because only relatively low control currents are required and thus the value of the capacitor can be kept small.

Preferably, the lock movement is provided by a single mechanism which can be switched to provide first and second directions of lock movement which are opposite to one another. THe mechanism may comprise, for example, an electric motor or a rotary magnet having a driving direction which is reversible depending on the direction of induction current.

If different lock bolt mechanisms are to be used for each of the two directions of lock movement, or if the induction current of the lock bolt mechanisms is to be controlled by means of switching stages, the capacitor preferably is connected to the power source by the first contact path in series through a first diode to the lock bolt mechanism which provides the first direction of lock movement, or to its switching stage. Further, the capacitor preferably is connected in series by the second contact path through a second diode to the lock bolt mechanism which provides the second direction of lock movement, or to its switching stage. The polarity of each of the first and second diodes is arranged opposite to the polarity of the charged capacitor. The two diodes thus form a current divider, preferably arranged so that the diodes are connected in series and are polarized in the same direction. The series connected diodes are connected in parallel to the lock bolt mechanism which provides the first direction of lock movement, or its switching stage, so that the capacitor is connected between the connection point of the two diodes and a movable contact of the control switch. If desired, a third diode may be connected with the same polarity relative to the second diode between the lock bolt mechanism which provides the second direction of lock movement, or its switching stage, and the second contact path. This arrangement may be necessary for decoupling each switch if several switches are used effectively in parallel with one another.

An important advantage of the central locking system according to the invention is that several control switches may be provided so that the system can be placed in a locked or unlocked state from, e.g., the door lock of one of several doors. If switches without a neutral center rest position are used, the switches must be decoupled from one another by means of the diodes described above. A different capacitor is associated with each of the switches and each capacitor is connected by separate diodes with the lock bolt mechanisms or their switching stages. Advantageously, the diodes and the capacitors are mounted on a common plate at the location of the switch, i.e., the motor vehicle door. For connection of this circuit part with the lock bolt mechanisms, or their switching stages, only three connecting lines are required, one of which may be formed by the vehicle body or chassis.

If the switches have a neutral center rest position, corresponding contacts of the switches may be connected in parallel with one another to a common capacitor. The capacitor may be arranged together with the switching stages and any diodes which may be required on a common circuit plate. In such cases, only three connecting lines are required between the switches. When using the vehicle chassis, only two connecting lines are needed.

If the switches have a center rest position with fixed contacts at the center positions, and the movable contacts are connected in series to a common capacitor through the fixed center position contacts, then no diodes are necessary for decoupling of the switches. The fixed switch contacts which correspond to one another and form parts of the first and second contact paths are connected in parallel. Likewise, only two or three connecting lines are needed between the switches.

In case of an accident, rescue personnel often cannot enter the vehicle because the occupants have locked the doors beforehand. In a preferred embodiment, which is also important in other electric central locking systems, the lock bolt mechanisms which provide movement in an unlocking direction, or a switching stage which switches the induction current for these mechanisms, are connected with a driver stage which, in turn, is connected to a power source and is controlled by an acceleration sensitive switch responsive to vehicle acceleration. The acceleration switch then responds during an accidental impact, and the doors of the vehicle are automatically unlocked. This acceleration switch may comprise a switch contact which is activated by inertia of a certain body.

The acceleration switch can be connected to the lock bolt mechanisms or their switching stages by a diode with its polarity arranged to conduct current from the power source in the forward direction. The diode decouples the acceleration switch circuit from the remaining circuitry of the system.

If, due to its construction, the acceleration switch does not remain in a release position after it has been activated, but may return to a rest position, then care must be taken that the pulse generated by the acceleration switch is converted into a driving pulse sufficiently long for energizing the lock bolt mechanisms. Preferably this is achieved by connecting the acceleration switch to a charging circuit of a capacitor which is connected to the power source, and by providing an electronic switch for control of the lock bolt mechanisms or their switching stages. The control input of the electronic switch is connected to a discharging circuit which is switched parallel to the capacitor, and the charging circuit is arranged to have a shorter time constant than the discharging circuit. Accordingly, the capacitor is charged even during momentary closing of the acceleration switch, and is again discharged during a comparatively longer time span which is sufficient for unlocking. The capacitor also ensures that the lock bolt mechanisms remain connected for only a limited time.

For limiting the time period during which the lock bolt mechanisms must be energized to be unlocked, a self-holding type of acceleration switch may be arranged so that the switch is connected to the power source in series through a capacitor and the lock bolt mechanisms, or their switching stages, and a discharging resistor may be connected in parallel to the capacitor.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

BRIEF DESCRIPTION OF THE DRAWING

In the drawing

FIGS. 1–5 are electrical schematic diagrams of various embodiments of a central locking system according to the invention; and FIGS. 6 and 7 are electrical schematic diagrams of two circuits for switches of the type which unlock the central locking system in response to acceleration of the vehicle.

DETAILED DESCRIPTION OF THE INVENTION

Figure 1:
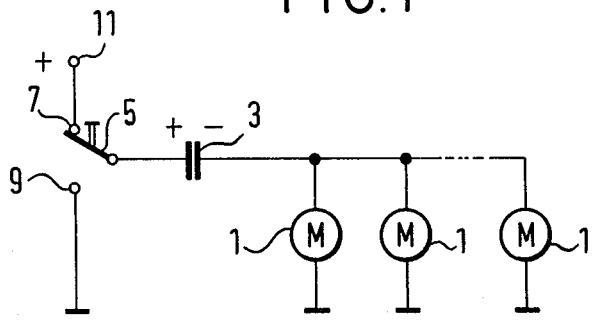

FIG. 1 shows a circuit diagram of an electric central locking system in which locks which may be located at the doors and hoods of a motor vehicle (not shown) can be secured or released from a central location. The mechanisms associated with the locks are each driven by motors 1 or rotary magnets in either a locking or a releasing direction. The motors 1 are arranged in parallel and are connected at one terminal to an electrolytic capacitor 3 which, in turn, is connected with a movable contact of a single pole switch 5. The switch 5 has two fixed contacts 7,9. The fixed contact 7 is connected to one terminal 11 of a power source, e.g., the positive terminal of a vehicle battery, while the other fixed contact 9 is connected by the vehicle chassis with the other terminal of the power source, as are the remaining terminals of the motors 1.

In a first position of the switch 5, the movable contact rests against the fixed contact 7, and a charging current flows through the capacitor 3 as well as through the parallel connected motors 1, while the current charges the capacitor 3. The charging current drives the motors 1 in a first direction, e.g., in the locking direction. When the switch 5 is switched to the second position, the capacitor 3 is connected in parallel with the motors 1 and discharges through the motors 1. The discharging current is directed oppositely to the charging current, and drives the motors 1 in the opposite direction to release the locks. The motors 1 are driven merely by a current pulse during locking as well as during release, so that they do not have to be designed to handle a steady load current. The duration of the drive pulse is determined essentially by the capacity of the capacitor 3 and the internal resistance of the motors 1. The switch 5 may comprise a commercially available microswitch which can be activated, for example, by a lock cylinder in a vehicle door on the driver's side. This microswitch can be constructed so as to assume a rest state at either of the locking and the release positions.

Figure 2:
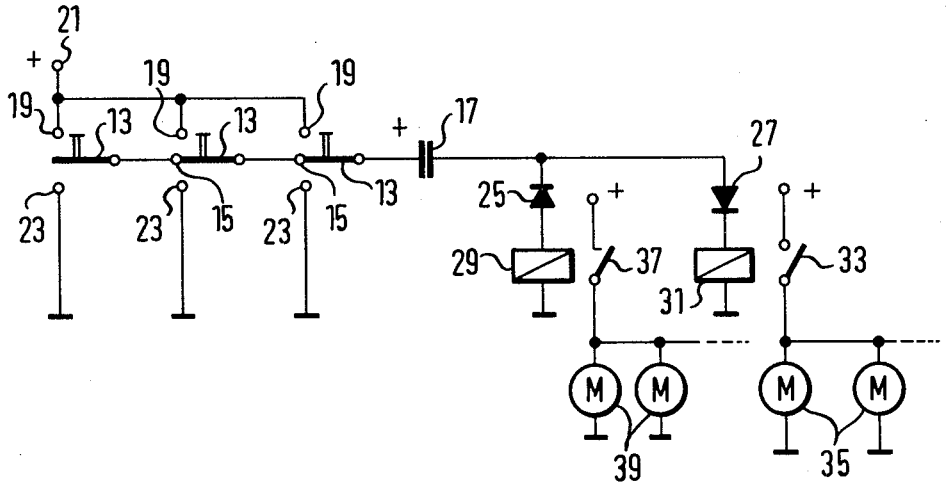

FIG. 2 shows another embodiment of a central locking system which differs from the system of FIG. 1 in that it can be placed in a lock or a release state by several switches 13 each of which is located at a different door of the vehicle. The switches 13 have a center rest position to which they are returned by way of the lock cylinder of the door lock (not shown). The movable contacts of the switches 13 are connected in series through fixed center contacts 15 of the switches, and then are connected to one terminal of an electrolytic capacitor 17. Fixed switch contacts 19 are associated with, e.g., the locking direction of lock movement and are each connected to a terminal of a power source, while the remaining fixed contacts 23, which serve to initiate the release operation, are connected to the vehicle chassis as is the remaining terminal of the power source. Two relays 29,31 have each of their windings connected through corresponding diodes 25,27 between the vehicle chassis and the other terminal of the capacitor 17.

The diodes 25,27 form a current divider and are arranged to be of opposite polarity in relation to the polarity of the charged capacitor 17. The diode 27 is biased in the forward direction during the flow of charging current through the capacitor 17 so that the relay 31 is energized when one of the switches 13 is switched to the fixed contact 19. The relay 31 controls the induction current of parallel connected motors 35, or rotary magnets (not shown) for securing the locks, by way of relay contact 33.

Diode 25 is biased in the forward direction during the flow of discharge current from the capacitor 17, which current flows during positioning of one of the switches 13 to fixed contact 23. This discharge current energizes the relay 29. Relay 29 controls the induction current of parallel connected motors 39, which rotate to provide the release bolt movement, by way of relay contact 37.

Since the internal or winding resistance of the relays 29,31 is greater than the internal resistance of the parallel connected motors 35,39, relatively small currents flow through the capacitor 17 so that its capacitance value may be relatively small. Instead of using separate motors for providing the locking and release movements, motors or rotary magnets which can be driven in both directions of rotation may also be used if the relay contacts 33,37 are associated with a pole reversing switch. In addition to the chassis connection, only two additional connecting lines are necessary for connection of the switches 13 with one another.

Figure 3:
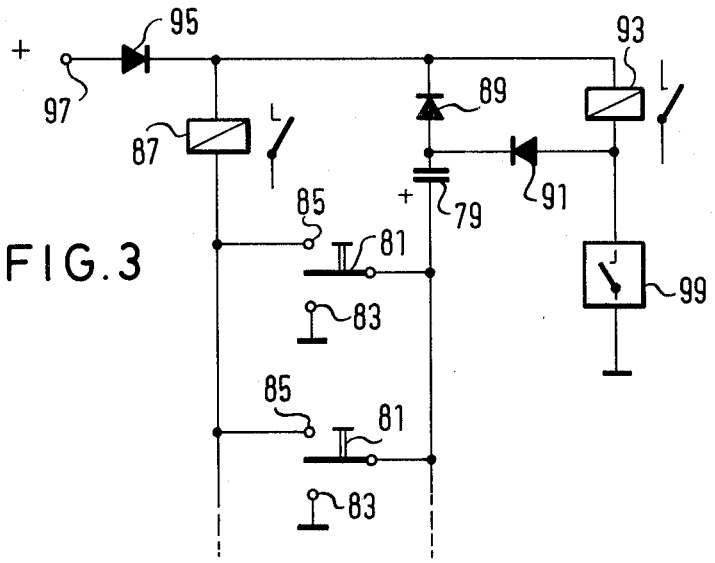

FIG. 3 shows a central locking system for motor vehicles which, similar to the system of FIG. 2, uses a single capacitor 79 and is also controlled by a number of single-pole switches 81 arranged independently of one another Each switch 81 has a neutral central rest position. However, unlike the system of FIG. 2, there is no need for a fixed center position contact on each switch. The movable contacts of the switches 81 are all connected to one terminal of a capacitor 79. A first fixed contact 83 of each switch 81 is connected to the vehicle chassis. A second fixed contact 85 of each switch 81 is connected with one terminal of the winding of a relay 87, and the other winding terminal is connected through a diode 89 to the other terminal of the capacitor 79. The other terminal of the capacitor is also connected to a power source 97 in series through a diode 91, the winding of a relay 93, and a reverse polarity protecting diode 95. The junction of the diode 89 and the winding of the relay 87 is also connected to the protecting diode 95.

When the movable contact of the switch 81 is switched from the neutral center rest position to the fixed contact 83, a current flows through the protecting diode 95, the winding of the relay 93, and the diode 91 to charge the capacitor 79, and then to chassis ground. As the current charges the capacitor 79 the relay 93 is energized. Consequently, the lock bolt mechanisms of the system (not shown) which are connected in parallel with the contacts of the relay 93, and which operate to provide release lock movement, are switched on during the charging of the capacitor 79. If the movable contact of the switch 81 is connected to the fixed contact 85, then the charged capacitor 79 is discharged by diode 89 and the winding of relay 87 so that the lock bolt mechanisms which provide locking movement, and are connected with the contacts of the relay 87, are switched on. In case of a vehicle accident, a switch stage 99 energizes the relay 93 in accordance with deceleration to unlock or release the locking system.

Figure 4:
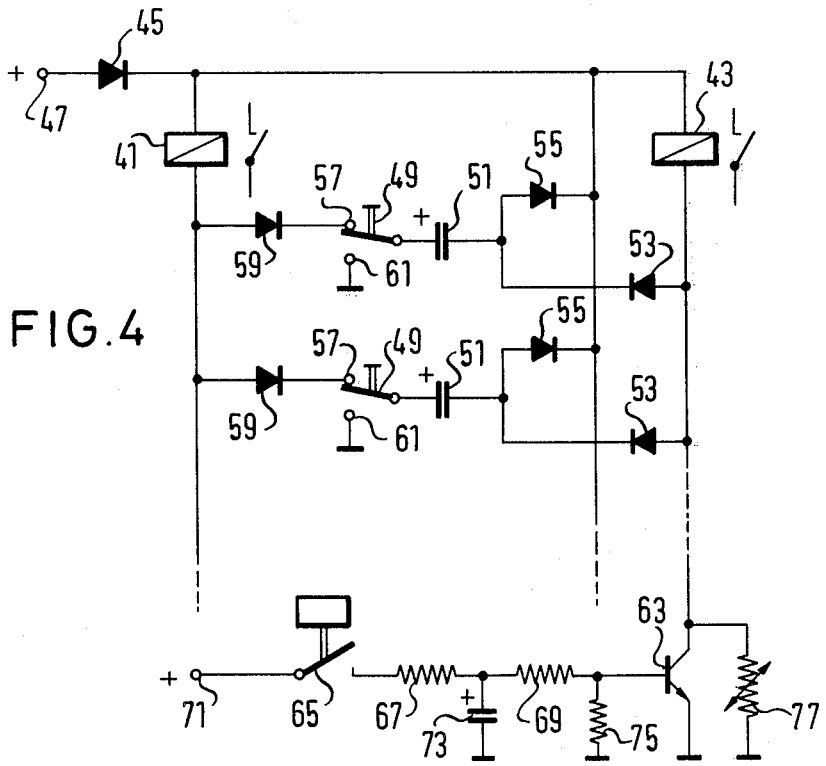

FIG. 4 shows a circuit diagram of a central locking system including switches which, unlike those in the system of FIGS. 2 and 3, do not require a central rest position. In the system of FIG. 4, the windings of two relays 41 and 43, which correspond to the relays 29 and 31 of the system of FIG. 2, are connected to a terminal 47 of a power source, e.g., the vehicle battery through a reverse polarity protecting diode 45 which is biased in the forward direction. The central locking system of FIG. 4 is controlled by several single-pole switches 49 which can be arranged at each of the vehicle doors and which have movable contacts each connected to a different electrolytic capacitor 51 in series with a diode 53 and the winding of relay 43. Diodes 55 are connected at one end between the junctions of the diodes 53 and the capacitors 51, and at the other end to the protecting diode 45. Each set of diodes 53 and 55 is arranged to be of opposite polarity in relation to the polarity of the associated charged capacitor 51, and the diodes 53,55 are connected in series with one another in relation to the winding of the relay 43. Accordingly, each set of series connected diodes 53,55 is connected in parallel with the winding of the relay 43. Diodes 59 are connected between the corresponding first fixed contacts 57 of the switches 49, and the winding of the relay 41, while the remaining second fixed contact 61 of the switches 49 are connected to the vehicle chassis.

If the movable contact of one of the switches 49 is connected with the fixed contact 61, then a charging current flows through the protecting diode 45, the winding of the relay 43 and the diode 53 to the associated capacitor 51. The charging current energizes the relay 43 and activates the lock bolt mechanisms (not shown) which are connected to the contacts of the relay 43 while the charging current flows, and thereby releases the central locking system. Since the movable contacts of the switches 49 are coupled to one another, the remaining switches 49 also are switched to their fixed contacts 61.

To secure the central locking system, the movable contact of one of the switches 49 is switched to the fixed contact 57. Therefore, the capacitor 51, which was charged during the release operation, is connected parallel to the winding of the relay 41 through the diodes 55 and 59, so that the relay 41 is energized by the discharging current of the capacitor 51 and switches the lock bolt mechanisms for movement in the securing or locking direction by way of the relay contacts. The lock bolt mechanisms, in turn, also switch the movable contacts of the remaining switches to the fixed contact 57.

An important advantage of the system according to FIG. 4, as compared to the systems of FIGS. 2 and 3, is that the capacitors can no longer discharge even under unfavorable operating conditions, such as periods during which a motor vehicle equipped with the system remains idle.

Only three connecting lines are required to connect the switches 49 with the relays 41,43. The diodes 53,55 and 59, as well as the capacitor 51, preferably are arranged on a common circuit board near each switch 49, i.e., in the vicinity of a lock to be secured.

A collector of a switching transistor 63 is connected to the winding of the relay 43 which energizes the lock bolt mechanisms for movement in the release direction. The transistor emitter is connected to the chassis so that the relay 43 is energized when transistor 63 is in a switched-on state. The switching transistor 63 is controlled by an acceleration switch 65 which is connected in series in relation to two resistors 67,69 between a source of operating voltage 71 and the base of the switching transistor 63. The acceleration switch 65 is closed by an element which is subject to inertia during deceleration in case of a motor vehicle accident, so that a capacitor 73 connected between the junction of the resistors 67,69 and the vehicle chassis is charged. The voltage developed by the charged capacitor 73 is applied to the switching transistor 63 through the resistor 69, so that the relay 43 is energized and the central locking system is automatically unlocked in case of an accident. A resistor 75 is connected between the transistor base and the emitter to establish the operating or turn-on point of the switching transistor 63. The value of the resistor 67 is substantially smaller than that of the resistor 69, so that the capacitor 73 is charged within a relatively short time, while the charged capacitor 73 discharges relatively slowly through the resistor 69. The switching transistor 63 therefore remains on for a period of time sufficient to release the system. A voltage dependent resistor 77, or a Zener diode, may be connected parallel to the collector-emitter path of the switching transistor 63, as shown in FIG. 4, so as to limit the maximum collector-emitter voltage applied to the switching transistor 63.

The central locking system of FIG. 5 corresponds substantially to the system of FIG. 4. However, the charging or discharging currents are used to control transistor switches and, for this reason, capacitors having smaller capacitance values may be used.

The circuit includes a switching stage including a relay 103 or 105 for each of the locking and release directions of movement provided by the system. The relay contacts switch the induction current of corresponding lock bolt mechanisms (not shown). The relays 103,105 are connected in series with the collector-emitter paths of switching transistors 107,109 and a power source terminal 110. The windings of the relays 103,105 are bridged by protective diodes 111,113, while voltage-dependent resistors 115,117, e.g., Zener diodes, are connected in parallel to the collector-emitter paths of the switching transistors 107,109. Resistors 119,121 establish the transistor operating points and are connected in parallel to the base-emitter paths of the switching transistors 107,109. In addition, a current limiting resistor 123 or 125 is connected to each transistor base.

The operation of the above switching stages is controlled by a number of single-pole switches 127. Unlike the system of FIG. 3, the switches 127 do not require a center rest position. The movable contact of each switch 127 is connected through a capacitor 129 and diode 131 to the current limiting resistor 125. A first fixed contact 133 of each switch 127 is connected to the power source terminal 110 which is tied to the relays 103,105. The other, second fixed contact 135 of each switch 127 is connected through a diode 137 to the current limiting resistor 123. Another diode 139 is connected at one end between the junction of the capacitor 129 and the diode 131, and at the other end to the vehicle chassis. The diodes 131 and 139 are arranged to be of opposite polarity in relation to the polarity of the charged capacitor 129.

When the movable contact of one of the switches 127 is connected with the fixed contact 133, a charging current then flows through the fixed contact 133, the capacitor 129, the diode 131, the current limiting resistor 125 and the resistor 121 or the base of the switching transistor 109 to turn the switching transistor 109 on, and thus energize the relay 105. The lock bolt mechanisms (not shown) which operate in the release direction then are connected by the contacts of the relay 105 for the duration of the flow of charging current. When the movable contact of one of the switches 127 is connected with the fixed contact 135, then a discharging current flows through the diode 137, the current limiting resistor 123, the resistor 119 or the base of the switching transistor 107, and the diode 139 to discharge the capacitor 129. The switching transistor 107 thus is turned on and the relay 103 is energized. The lock bolt mechanisms (not shown), which are tied to the contacts of the relay 103, are energized over the duration of the flow of the discharge current for locking movement.

The switching transistor 109 also can be switched on during a deceleration of the motor vehicle, caused by an accident, by way of a diode 141 connected at one end to the current limiting resistor 125 and connected at the other end in series through a resistor 143 to an acceleration switch 145 which is connected to the power source. Therefore, the system can be automatically unlocked in case of an accident, similar to the system of FIG. 4. A capacitor 147 is connected to the junction of the resistor 143 and the diode 141. Capacitor 147 corresponds to the capacitor 73 of FIG. 4, and extends the response time of the acceleration switch 145.

As shown in FIG. 6, if an acceleration switch 149 with a sufficiently long switch-on time is used, the switch 149 can directly control the release switching stage through a diode 151.

FIG. 7 shows another arrangement in which an acceleration switch 153 is provided which automatically locks in a contacting position after being triggered. In order to allow the steady current rating of the release switching stage to be as small as possible, the acceleration switch 153 is connected in series through a capacitor 155 and a diode 157 to the switching stage. A discharging resistor 159 is connected in parallel to the capacitor 155.

In the embodiments of FIGS. 3 to 7, the polarity of the power source can be changed from that shown when the polarity of the diodes used is inverted and, when PNP transistors are used instead of NPN transistors, the latter being shown in the figures. In either circuit arrangement, one of the leads of the power source may be formed by the chassis of the motor vehicle.

While specific embodiments of the invention have been shown and described in detail to illustrate the application of the inventive principles, it will be understood that the invention may be embodied otherwise without departing from each principles.

What is claimed is:

1. A central locking system for locking or opening a number of closure members of buildings or vehicles at one time in response to actuation of a control switch, comprising a number of lock bolt mechanisms each for providing lock movement in a selected one of first and second directions to a lock element associated with one of the closure members in response to a drive pulse, at least one control switch which is selectively actuable to one of a first and a second switching position, a pulse drive circuit including a capacitor coupled to each of said lock bolt mechanisms wherein said drive circuit produces a selected one of a first drive pulse corresponding to the first direction of lock movement and a second drive pulse corresponding to the second direction of lock movement in response to current which flows through said capacitor, a charging current circuit coupled to said capacitor for directing a charging current to said capacitor to produce said first drive pulse when said control switch is moved to said first switching position so that said lock bolt mechanisms move the lock elements in the first direction, a discharging current circuit coupled to said capacitor for directing a discharging current from said capacitor to produce said second drive pulse when said control switch is moved to said second switching position so that said lock bolt mechanisms move the lock elements in the second direction, wherein said control switch comprises a single-pole switch including a first contact for forming part of a first contact path wherein a power source is connected in series with said capacitor and said lock bolt mechanisms for providing lock movement in the first direction, and a second contact for forming a part of a second contact path wherein said capacitor is connected in parallel to said lock bolt mechanisms for providing lock movement in the second direction, and electronic switches for actuating said lock bolt mechanisms, said electronic switches including control electrodes coupled to said capacitor for switching a current in response to a voltage applied to said control electrodes.

2. A central locking system for locking or opening a number of closure members of buildings or vehicles at one time in response to actuation of a control switch, comprising lock bolt means for providing lock movement in a selected one of first and second directions to lock elements associated with the closure members in response to a drive pulse, at least one control switch which is selectively actuable to one of a first and a second switching position, a pulse drive circuit including a capacitor arranged to produce a selected one of a first drive pulse corresponding to the first direction of lock movement and a second drive pulse corresponding to the second direction of lock movement in response to current which flows through said capacitor, a charging current circuit coupled to said capacitor for directing a charging current to said capacitor to produce said first drive pulse when said control switch is moved to said first switching position, and a discharging current circuit coupled to said capacitor for directing a discharging current from said capacitor to produce said second drive pulse when said control switch is moved to said second switching position, wherein said control switch comprises a single-pole switch including a first contact for forming part of a first contact path wherein a power source is connected in series with said capacitor and said lock bolt means for providing lock movement in the first direction, and a second contact for forming part of a second contact path wherein said capacitor is connected in parallel to said lock bolt means for providing lock movement in the second direction, a first diode connected in series with said capacitor, said power source and said lock bolt means when said first contact of said control switch provides said first contact path, and a second diode connected in series with said capacitor and said lock bolt means when said second contact of said control switch provides said second contact path, said first and said second diodes being arranged to be of opposite polarity in relation to the polarity of said capacitor when charged by said charging current.

3. A central locking system according to claim 2, wherein said first and said second diodes are connected in series with the same direction of polarity, said series connected diodes are together connected in parallel to said lock bolt means when said first contact of said control switch provides said first contact path, and said capacitor is connected between the junction of said first and second diodes and a movable contact of said control switch when said second contact provides said second contact path.

4. A central locking system according to claim 3, including a third diode arranged to be connected between said lock bolt means and said second contact when said second contact provides said second contact path, said third diode being of the same polarity relative to said second diode.

5. A central locking system according to claim 2, including a number of said control switches, a number of said capacitors each associated with a different one of said control switches, and a number of sets of diodes each set being arranged to connect a different one of said capacitors to said lock bolt means.

6. A central locking system according to claim 2, including a number of said control switches, each of said control switches including a movable contact and having a neutral center rest position at which said movable contact is unconnected, said first fixed contacts of said number of control switches being connected to one another and said second fixed contacts of said number of control switches being connected to one another so that said first and second fixed contacts are arranged to switch current through said capacitor.

7. A central locking system according to claim 2, including a number of said control switches, each of said switches having a center rest position and including a movable contact and a fixed center position contact for contacting said movable contact when said switch is in the center rest position, said first fixed contacts of said number of control switches being connected to one another and said second fixed contacts of said number of control switches being connected to one another, said movable contacts of said number of control swtiches being connected in series to said capacitor through said fixed center position contacts.

* * * * *